US005229753A

United States Patent [19]

Berg et al.

[11] Patent Number: 5,229,753

[45] Date of Patent: Jul. 20, 1993

[54] WARNING DEVICE FOR A WASHING APPARATUS WHICH ADVISES WHETHER ITS CONTENTS ARE CLEAN OR SOILED

[76] Inventors: Richard P. Berg, 2071 Hopewell Ct., Thousand Oaks, Calif. 91360; Floyd L. Berg, 24391 Wagon Wheel La., Lake Elsinore, Calif. 92330

[21] Appl. No.: 712,945

[22] Filed: Jun. 10, 1991

[51] Int. Cl.[5] ..... G08B 21/00; D06F 33/00; B08B 3/00; H01H 3/02

[52] U.S. Cl. ..... 340/679; 68/12.27; 134/113; 200/85 R; 250/222.1; 340/309.15; 340/326; 340/522; 340/545; 340/556; 340/666; 340/692

[58] Field of Search ..... 340/540, 679, 309.15, 340/691-692, 555-557, 666, 674, 528-530, 545, 568, 521, 326; 134/113, 58 D; 68/12.04, 12.27; 250/222.1; 200/61.76, 85 R; D32/2-3; 177/45, 245

[56] References Cited

U.S. PATENT DOCUMENTS

| | | | |
|---|---|---|---|
| 2,412,270 | 12/1946 | Johnston | 340/666 X |
| 3,608,514 | 9/1971 | Dunn | 134/113 X |
| 3,861,413 | 1/1975 | Woehler | 134/58 D X |
| 3,927,571 | 12/1975 | Athey | 340/691 X |
| 4,623,879 | 11/1986 | Woestman | 340/540 X |
| 4,916,439 | 4/1990 | Estes et al. | 340/679 |
| 4,987,407 | 1/1991 | Lee | 340/540 |
| 5,069,235 | 12/1991 | Vetter et al. | 134/113 |
| 5,165,260 | 11/1992 | Geiger | 68/12.04 |

FOREIGN PATENT DOCUMENTS

| | | | |
|---|---|---|---|
| 3503141 | 8/1986 | Fed. Rep. of Germany | 134/58 D |
| 9013698 | 11/1990 | World Int. Prop. O. | 68/12.27 |

*Primary Examiner*—Thomas Mullen
*Attorney, Agent, or Firm*—Ladas & Parry

[57] ABSTRACT

An indicating system for a washing device having has at least one rack for holding articles during the washing of same and a door for gaining access to the articles. The indicating system includes a detector for sensing whether or not the rack holds articles and logic circuits responsive to the detector and to the operating state of the washer for providing an indication that the articles have been cleaned when a predetermined operating state is detected and for providing an indication that any articles in the washer are not clean after the detector senses that the articles in the rack were removed from the at least one rack.

37 Claims, 5 Drawing Sheets

FIG. 1
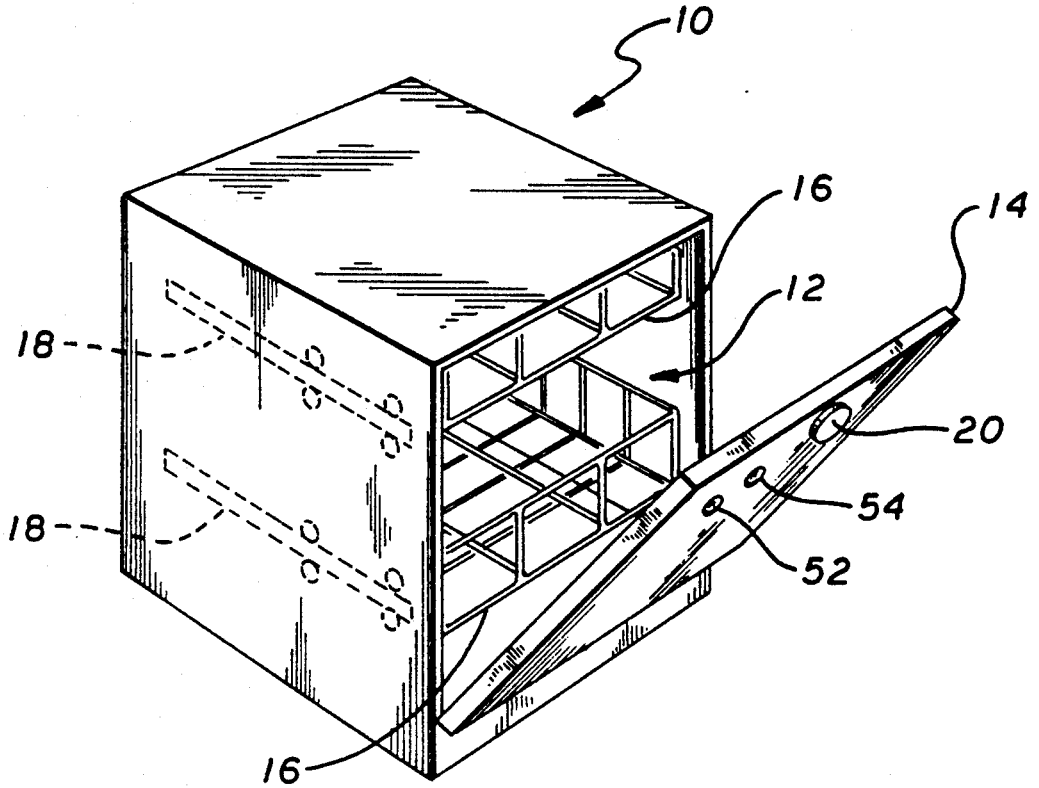
FIG. 2A
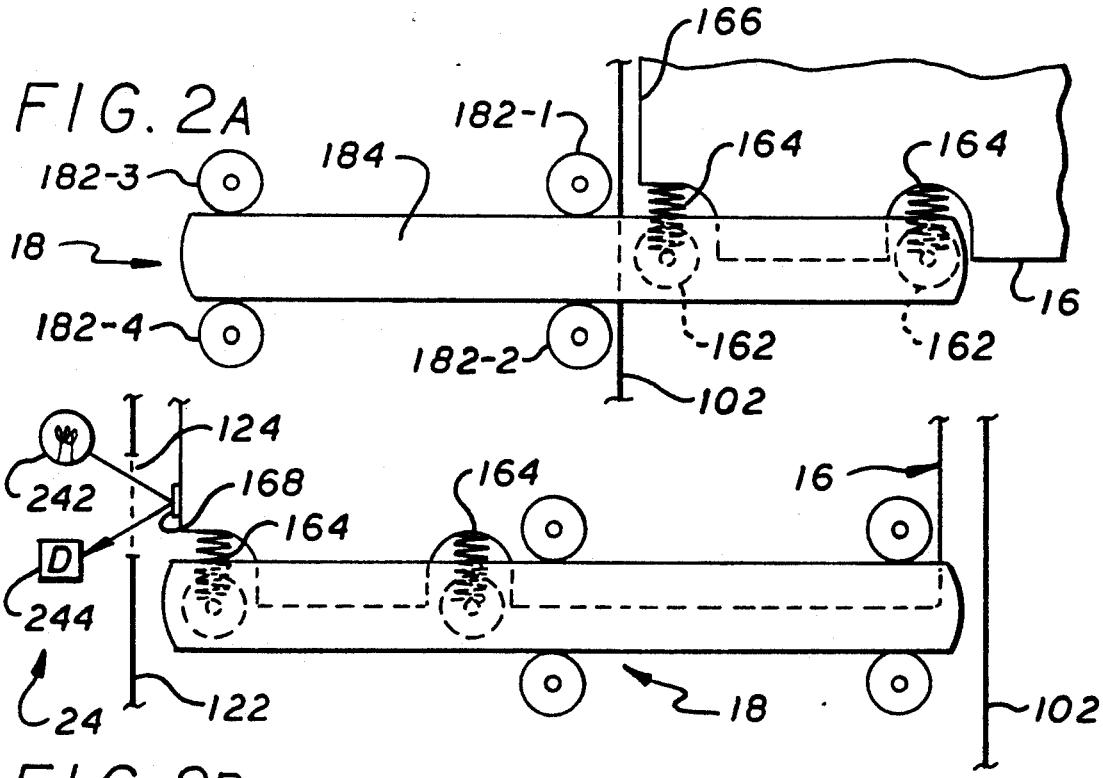
FIG. 2B

CLEAN (40)
SOILED (42)
S
R
26
LATCH
36
28
34
TIMER
S
R
38
DOOR OPENED
35
30
SINGLE SHOT
204
WASH
DRY
END
START
202
UPPER SENSOR
LOWER SENSOR
244
244
242
242
24
LAMP CONTROL
246
DOOR CLOSED
32

CLEAN
EMPTY
SOILED
44
S
R
FLIP FLOP
40
S
R
FLIP FLOP
26
36
38
DOOR OPENED
34
TIMER
S
R
37
28
30
SINGLE SHOT
62
1
42
42
60
+V
U.S.
L.S.
244
244
242
242
DOOR CLOSED
32
LAMP CONTROL
246
WASH
DRY
END
START
202
24

WARNING DEVICE FOR A WASHING APPARATUS WHICH ADVISES WHETHER ITS CONTENTS ARE CLEAN OR SOILED

TECHNICAL FIELD

This invention relates to a warning system for an automatic washer, the warning system advising whether the articles in the washer are clean or soiled. In particular, the present invention may be utilized with an automatic dishwasher of the type frequently used in homes and restaurants. The warning system gives a visual and/or an audible signal that the articles, i.e. dishes, are clean so that a user of the automatic washer is less likely to load soiled articles, i.e. dishes, into the washer before unloading the clean articles.

BACKGROUND OF THE INVENTION

The automatic dishwasher is now a very common appliance, found in many homes and restaurants. Of course, it takes some time, usually on the order of an hour, for the dishwasher to clean and dry a load of soiled dishes. With the time pressures of modern society that means that the user of the automatic dishwasher is not going to sit around and wait for the dishwasher to complete its cycle of washing and drying its contents, but rather the user will do other chores, go to work, rest or even go to sleep, Sometime later the user or a third party, such as another member of the user's family (if the dishwasher is installed in a home) or a co-worker (if the dishwasher is installed in a restaurant), will have a need to clean further dishes and will load newly soiled dishes into the dishwasher not realizing until it is too late that the dishes in the machine are (were) clean. But now spoiled dishes have been commingled with the previously clean dishes. Practically speaking, that usually means that the entire load of commingled clean and soiled dishes must now be washed. The inadvertent error of loading a few soiled dishes into a dishwasher of previously washed and dried dishes causes not only aggravation, but also wastes water and energy resources, since more loads of dishes are washed than is really necessary.

An objective of the invention is to improve dishwashers so as to give a visual and/or an audible indication that the dishes in the dishwasher are clean or are soiled thereby saving energy, soap, water and aggravation which otherwise occurs when soiled articles are mixed with clean articles.

These objectives are achieved as is now described. A washing machine has a cavity which accepts soiled articles, which are placed on movable racks disposed in the cavity, and washes them in soapy water or other cleansing liquid, rinses the articles, optionally dries the articles and then holds them in the racks until removed. A typical automatic dishwasher has two racks which can each move into and out of the cavity to facilitate unloading clean dishes from the racks and loading soiled dishes into the racks. A water tight door, typically on the front of the machine, provides access to the washing cavity and the racks can move through the door's opening. The machine is provided with means for sensing when the articles to be washed are placed into the machine and when they are subsequently removed. Such a sensing means may be provided by a device for weighing, or more correctly, detecting changes in weight of the racks, including any dishes disposed in the racks.

The machine has an on-off switch, usually part of a timing apparatus, for controlling a pump used to direct water and cleaning substances at the dishes in the washer. The timing apparatus also controls electrically operated valves which admit fresh water into the cavity and permit the discharge of used water from the cavity as well as permit the introduction of cleaning substances into the cavity.

A warning device or indicator is provided which has at least two positions, for example "CLEAN" and "SOILED", signifying that the cavity either contains clean dishes or is ready to receive soiled (i.e. used, dirty) dishes. Initially, when the dishwasher is empty the warning indicator assumes its "SOILED" position indicating that the cavity is prepared to receive (or actually contains) soiled dishes. The indicator is set to its "CLEAN" position at or near the end of a washing cycle by means of the timing apparatus. The indicator is set back to its "SOILED" position when the racks of the washer have been unweighted, that is, the dishes have been removed from the racks, as sensed by the sensing means mentioned above.

The warning device can be provided by a pair of Light Emitting Diodes, or other visual display devices, such as Liquid Crystal Display devices. Preferably, however, the warning device is provided by an audible alarm or sound device such as a voice generator which would give an audible warning such as "The dishes are clean" whenever the door of the machine is opened after the completion of a washing cycle and before the dishes have been unloaded. At other times the voice generator can say something such as "Ready to receive soiled dishes" whenever the door is opened after the clean dishes had been removed as sensed by the sensing device.

An electronic latch is connected to the on-off switch and timing mechanism so as to set the latch when the washing cycle has completed. The latch is also connected to the at least one sensor to reset the latch whenever the dishes are unloaded. The set condition of the latch provides the CLEAN signal when the reset condition of the latch provides the SOILED signal.

BRIEF DESCRIPTION OF THE DRAWINGS

FIG. 1 is a schematic diagram of a automatic dishwasher generally of the type found in homes and restaurants, modified in accordance with the teachings of this invention;

FIGS. 2A and 2B are side elevation views of the mechanism that supports racks in the cavity of the washing machine, including the spring elements which make up part of the weight sensor, the two views showing the mechanism in its withdrawn state and in its retracted state;

DETAILED DESCRIPTION

Figure 3:
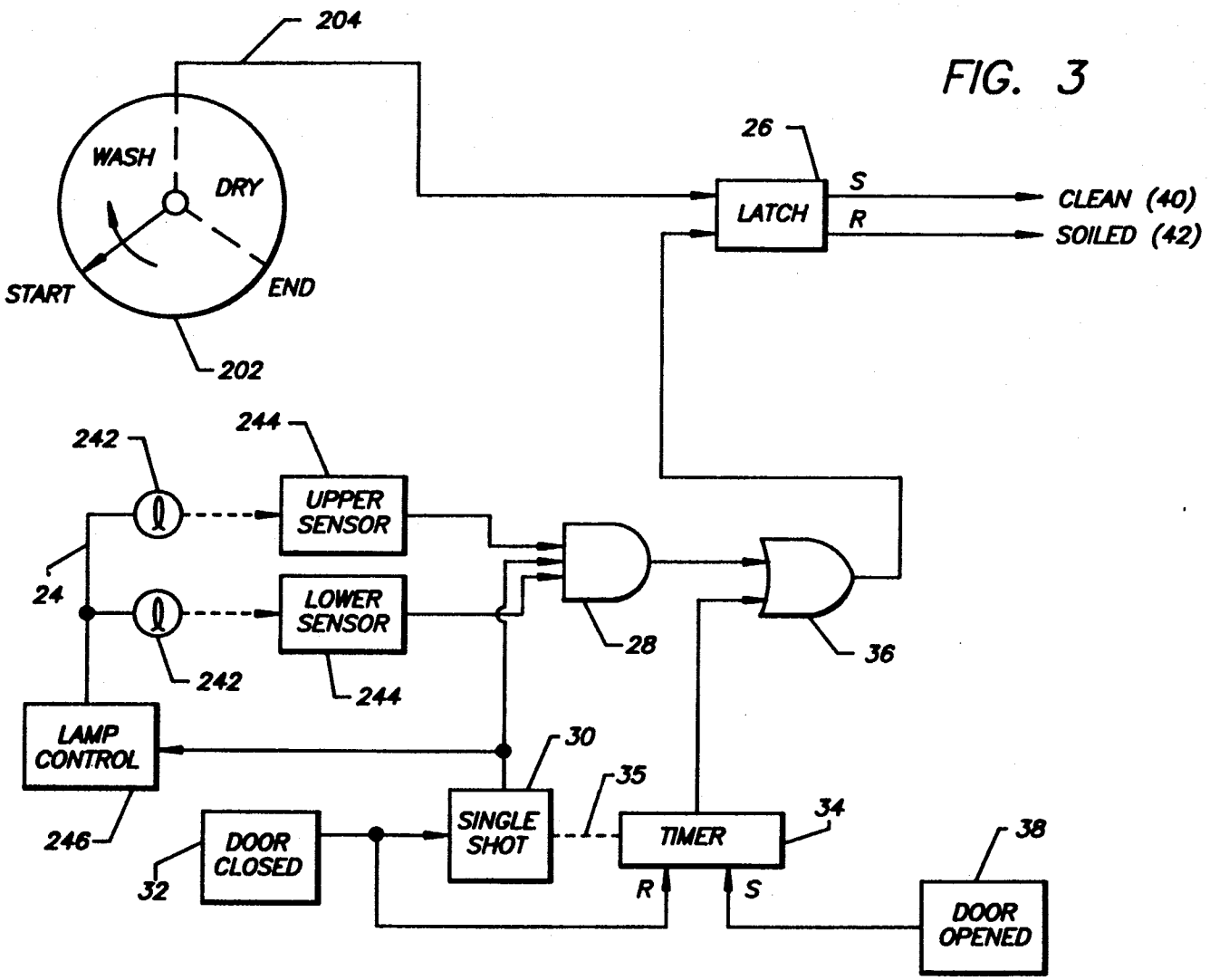
FIG. 3 is a schematic diagram of the latch and sensor circuitry.

FIG. 1 is a schematic, perspective view of a dishwasher 10 which has a cavity 12 for receiving soiled or dirty dishes and a water tight door 14. In the cavity are provided dish racks 16 for holding dishes. The dish racks are each mounted on two slide mechanisms 18, one on each side of the rack, to permit the racks to be withdrawn from the cavity thereby providing easy access to the dishes in the racks. Only one slide mechanism 18 is shown in FIG. 1 for each rack for ease of illustration, it being understood that each rack 16 would be equipped with two mechanisms 18, one on each side of the cavity 12.

The dishwasher typically has a pump (not shown) for pumping soapy and clean water through and out of the washer in a manner well known in the prior art. The pump, as well as various electrically controlled valves and heater elements (also not shown), are controlled by an on-off switch and timing mechanism, the control knob for which is seen at numeral 20 in FIG. 1. Warning indicators 52 and 54 can also be seen in this view and they will be described in greater detail subsequently.

Slide mechanisms 18 are shown in greater detail in FIGS. 2A and 2B. Each mechanism 18 includes a bar 184, preferably made of a corrosion resistent metal such as stainless steel, which is supported between four rollers 182, which rollers are numbered 182-1 through 183-4 and which rollers are rotationally mounted on the inner walls of cavity 12. The bar 184 is generally C-shaped and therefore has a central part which receives and supports a pair of rollers 162 associated with rack 16. The rack 16 is mounted on rollers 162 via springs or other compression means 164, which have a spring rate selected such that when the rack is filled with a normal load of dishes it preferably moves downwardly on the order of ¼ inch or so. In FIG. 2A the rack 16 is shown in its extended position such that the rear side 166 of the rack clears a front edge 102 of the washer 10 and its cavity 12, thereby providing access to the dishes (not shown) which can be loaded in rack 16. In FIG. 2B the slide mechanism and rack 16 are shown in their retracted, in-cavity position. In FIGS. 2A and 2B the springs 164 operate in compression, that is they compress when dishes are loaded into the associated rack. While this is the currently preferred arrangement, those skilled in the art will appreciate that the springs can instead be arranged below rollers 162 and thus go into tension when the rack is loaded with dishes. Also instead of using the depicted coil type springs other spring elements could certainly be used, such as, for example, leaf springs.

A sensor system 24 is provided to detect the loading and unloading of at least one and preferably both of the racks 17 in cavity 12. The sensor system includes a mirror, or other type of energy reflector, 168 mounted on the rear side 166 of the rack, for example. The cavity 12 has interior walls and a rear interior wall 122 can be seen in FIG. 2B. The interior walls are typically made of a corrosion resistent product, such as enameled steel. In the wall adjacent the energy reflector, which in this case is the rear wall 122, is placed one or more windows 124 and between the rear wall 122 of the cavity and the rear of the washer 10 are an energy source 242 and an energy detector 244. The window 124 should be selected of a material which readily passes the energy produced by source 242, reflected by reflector 168 and detected by detector 244. The window is positioned such that source 242, typically a light source, can direct energy, for example, light, therefrom and have it reflected back to detector 244, which is typically provided by a photodetector, from mirror 168 and through window 124, which may be made of glass, for example. Mirror 168 is preferably sized and located such that detector 244 receives a signal from source 242 only when its associated rack 16 is empty. Thus the mirror is rather short in the vertical direction, and the combination of the source 242, mirror 168, compression means 164 and detector 244 form the sensor system 24 for detecting whether or not dishes are present in rack 16. Of course, instead of arranging the mirror 168 such that detector 244 only receives energy when its associated rack is empty, it could instead be arranged to only receive energy when its associated rack is full, in which case appropriate logic changes will need to be made to the logic diagrams of FIGS. 3 and/or 6 and/or 7.

Since the dishwasher typically has at least two racks, a separate sensor system 24 is preferably provided for each rack 16. Since the soap used in a conventional dishwasher tends to be rather strong, the springs 164 or any other compression device selected as a part of the sensor system 24, should be corrosion resistant and able to withstand the harsh washing environment. For that reason it is suggested that stainless steel springs be used for this purpose.

Other sensor systems can be substituted for the sensor system 24 described above. For example, instead of mounting springs 164 on the rack 16 itself, they could instead be mounted on the axle of rollers 182. Since rollers 182-2 and 182-3 would be more affected by a change in weight of the rack and its contents than would be the other two rollers (when the rack is in its extended position), axles of rollers 182-2 and 182-3 would be the best candidates for weight sensing. The springs (assuming that they are used as part of the weight sensing system) could be mounted outside cavity 12 thereby making the sensor used rather straightforward. If the sensor system detects loading of the axles of the rollers through the walls surrounding the cavity 12, then suitable watertight boots should be used about those axles to keep the cavity watertight.

FIG. 3 is a schematic logic diagram of the electronic latch and sensor circuitry. As indicated above, the dishwasher 10 typically has a timer mechanism 202 which is only schematically depicted in this view for ease of illustration and since timer mechanism 202 is often provided by a very conventional electro-mechanical timer. Of course, those skilled in the art will appreciate that timers employing microprocessor technology can be used in the alternative, if desired. In any event, the timer 202 is shown with an output 204 which becomes logically true at or near the end of the wash cycle. It should be appreciated that output 204 could become logically true at other times during the wash cycle, if desired. We prefer to have it occur at or near the end of the washing part of the cycle since some people will open the door of the washer to retrieve dishes before any drying has occurred and also because it seems premature to us to indicate that the dishes are clean before the approximate end of the washing part of the cycle.

Figure 4:
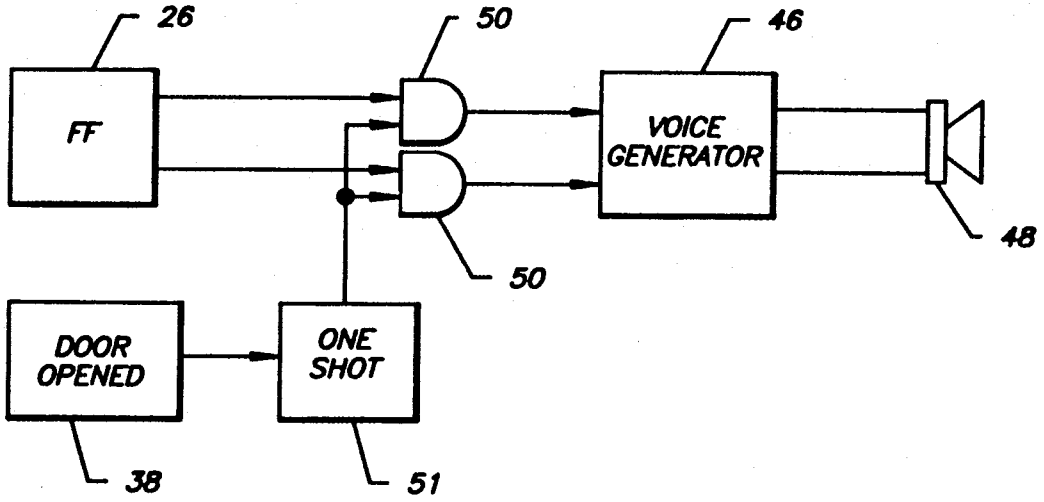
FIG. 4 is a schematic diagram of the warning circuitry which generates an audible warning.

Output 204 is effective to set a flip-flop latch 26 which, in turn, drives the warning devices depicted in FIGS. 4 and/or 5. The flip-flop has two states, a set state (S) and a reset state (R) into which the flip-flop is placed by the signals it receives at its inputs. When flip-flop 26 is set, that state corresponds to a CLEAN condition for the dishes in the washer since the washing part of the dishwasher's cycle has basically been completed. Of course, instead of obtaining the signal to set flip-flop 25 from timer 202, the signal could instead be derived from other components in the washer which reflect the current operating state, such as the operating condition of a pump, state of a valve, or the like.

Flip-flop 26 is also responsive to the outputs of the detectors 244 in the sensor system 24. Here one detector is denominated as the upper sensor 244 and the other as the lower sensor 242 since a conventional dishwasher will have two racks, one upper and one lower. Flip-flop 26 is reset in response to the door 14 be opened and the dishes being removed to thereby enable the SOILED indication 42. Thus a switch 32 or other sensor responsive to the closing of door 14 provides an output to a single-shot 30 which in turn causes energy sources 242, here shown as lamps 242, to be energized by a lamp control amplifier 246 for a short while after door 14 is closed. If upper and lower sensors 244 both detect light (or other appropriate energy from sources 242), that means that their associated racks have been emptied and if both racks are detected as being empty during the time one-shot 30 is turned on after door 14 is closed, then the outputs from one-shot 30 and the detectors 242 will be logically ANDed at AND gate 28 and the output of AND gate 28 will then reset flip-flop 26 via OR gate 36, whose function will be described subsequently. Single-shot 30 is preferably arranged to turn on for a short period of time, but preferably only turning on after an initial period of time after the closing door 14 is sensed by switch 32 to permit any mechanical oscillation imparted to the racks during the returning of the racks to their in-cavity position and the closure of door 14 to die down before allowing the sensor system 24 to detect whether or not dishes are disposed in racks 16.

The foregoing described circuitry of FIG. 3 works satisfactorily if the user of the dishwasher first empties the rack and close the door before loading soiled dishes into the dishwasher. If, however, the user immediately loads soiled dishes into the racks after emptying the racks, then the foregoing described circuitry would be "fooled" into reporting that the dishwasher was still full of clean dishes since it is then not given the opportunity to sense the fact that the racks had been first emptied when the sensor system is located at the rear of the racks as previously described. One way of overcoming this difficulty is to provide a timer 34 which measures the length of time door 14 remains open. If the time exceeds a predetermined amount of time, then an assumption is made that the racks are being emptied and filled with soiled dishes and thus when timer 34 times out before door 14 is closed, it sends a signal via OR gate 36 to flip-flop 26 to reset it, thus giving a "SOILED" indication. Timer 34 normally would be set to have a predetermined period of time on the order of 2 to 5 minutes, or whatever length of time is assumed or taken as the minimum period of time to unload and reload the dishwasher.

Another way of overcoming this difficulty is to locate the sensor system 24 such that it is operable even when door 14 is open. Thus, instead of using timer 34 to account for the situation where the dishes are unloaded and immediately replaced with soiled dishes (without closing door 14), the sensor system 24 can be located such that it will sense the unweighting of the racks 16 even when they are withdrawn from the cavity 12 (i.e. are in their extended positions on slide mechanisms 18). In that case the sensor system should not be triggered by environmental energy sources, such as light sources commonly found in a kitchen. One technique for attaining this end has previously been mentioned, namely, by sensing the weight at the axles associated with rollers 182-2 and/or 182-3. Another technique for attaining this end would be to make energy source 242 an ultraviolet (UV) source and thus detector 244 would then provide a logically true output in response to detecting an increase in UV energy. In this case the sensor system should be located near its associated rack even when the rack is in its withdrawn position of FIG. 2A, such as near roller 182-1. In order for the energy reflector to reflect the energy generated by source 242 regardless of whether its associated racks is in its withdrawn or retracted position, energy reflector 168 should be located at at least two positions along the side of its rack, namely at least near the rear of the rack (so as to reflect energy when the rack is withdrawn) and near the front of the rack (so as to reflect energy when the rack is retracted) or possibly along the entire length of the rack. Also, in addition to having the sensor system become active in response to the closing of door 14 (which causes one-shot 30 to subsequently fire), in this case the sensor system must also become active when the rack is withdrawn, and this can be accomplished, for example, by periodically activating lamp control 246 and enabling gate 28 under control of timer 34, for example, one every minute after the door 14 is opened (unless, of course, a more direct sensing system is used such as the sensing the of weight on the axles of rollers 182). This can be accomplished by modifying the circuitry of FIG. 3 to include connection 35 (shown in phantom) thereby having timer 34 periodically trigger one shot 30 when door 14 is open. By way of further modification of the foregoing, a sample and hold circuit would preferably be included between sensor 244 and AND gate 28, which sample and hold circuit holds a detected unweighted condition once it is detected and until reset (for example by the signal at numeral 204), to avoid requiring both racks to be empty at the same moment and also the sample and hold circuit preferably requires that the unweighted condition be sensed for some predetermined period of time before it would change state so that the detector system would not be unduly sensitive to mechanical vibrations imparted to the rack by merely withdrawing it from cavity 12.

Turning now to FIG. 4, previously discussed flip-flop 26 is preferably connected to an audible warning system to give an audible warning when door 14 is opened. Here door 14 opening is sensed by a switch 38 and thereafter a voice message is provided by voice generator 46 at speaker 48. If the flip-flop 26 is set then the message might be "The dishes are clean" as the flip-flop is set after the completion of a washing cycle and before the dishes have been unloaded and the voice generator 46 is enabled by the opening of the door 14 of the machine through the action of switch 38, a one-shot 51 and AND gates 50. At other times the voice generator 46 and speaker 48 can say something such as "Ready to receive soiled dishes" whenever the door is opened after the clean dishes have been removed as sensed by the sensing systems 24, i.e., when flip-flop 26 is reset. Those skilled in the art will appreciate that switches 32 and 38 can be implemented by physically the same switch by using a invertor to change the logic level from the switch to either AND gate 28 or AND gates 50, as appropriate. Suitable voice generators are well known in the prior art, as is exemplified by U.S. Pat. Nos. 4,209,844 and 4,310,831 and British Patent Number 2,098,835, the disclosures of which patents are incorporated herein by reference.

Figure 5:
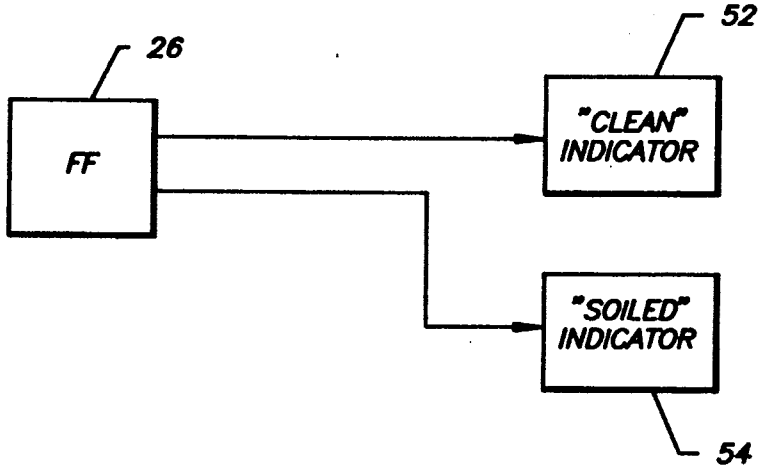
FIG. 5 is a schematic diagram of the warning circuitry which generates a visible warning.

FIG. 5 shows a visual warning system, the output of flip-flop 26 being provided to a display device 52 providing a "CLEAN" indication when the flip-flop 26 is set and to a display device 54 providing a "SOILED" indication when the flip-flop 26 is reset. Of course, the displays can be provided by simple, single Light Emitting Diodes (LED's) or by more sophisticated display devices, such as LCD's, showing the words "CLEAN" and "SOILED" or equivalent indicia. Display device(s) 52, 54 is (are) preferably mounted on the front of door 14 or at some other conveniently visible location and, if required, appropriate display driver device(s) should be used between the flip-flop 26 and displays 52, 54 in a manner known in the prior art. Those skilled in the art will appreciate, of course, that displays 52 and 54 may be implemented in a single display device or by separate display devices as a matter of design choice.

Both the audible warning system of FIG. 4 and the visual warning system of FIG. 5 may be used at the same time on the same dishwasher.

Figure 6:
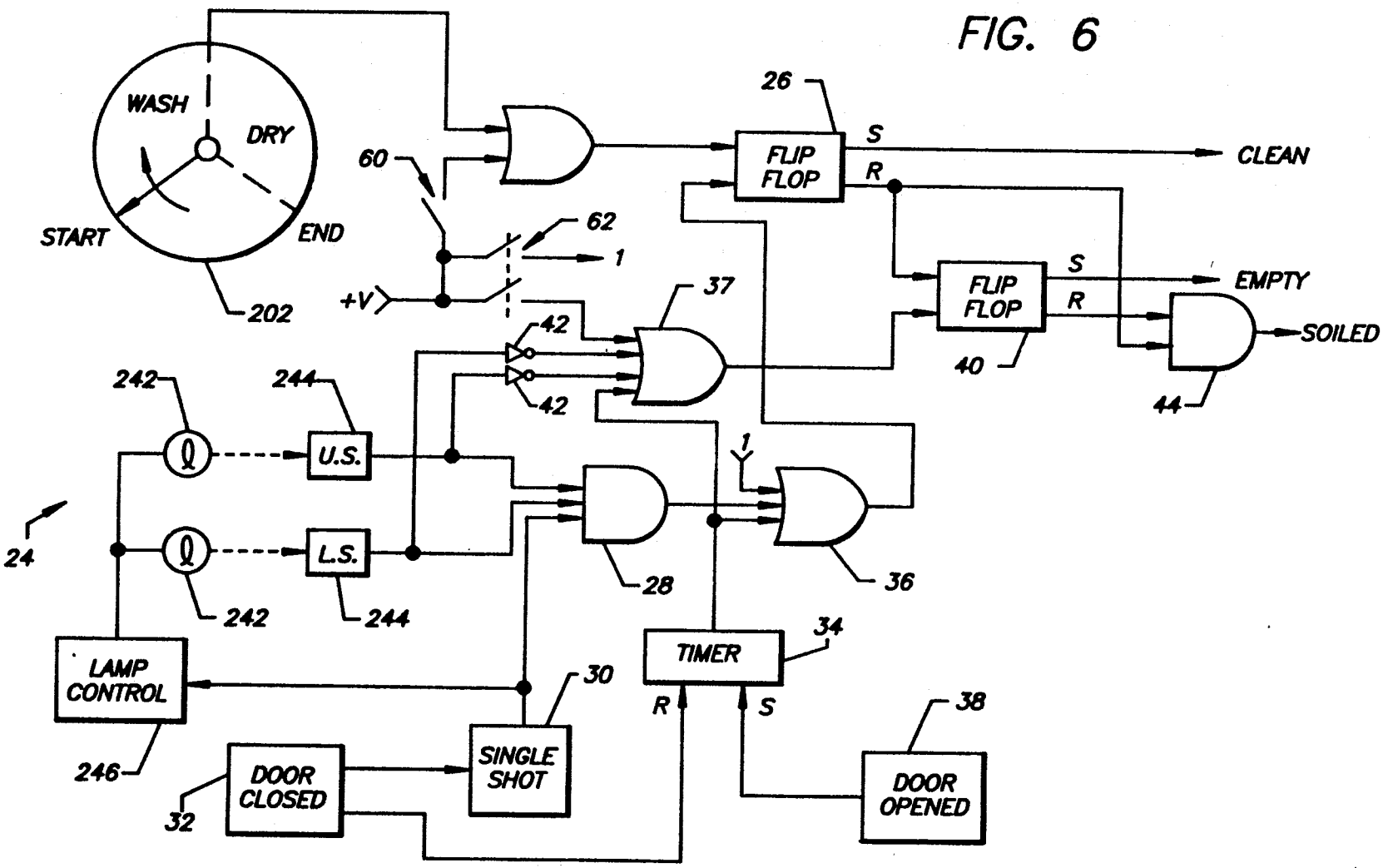
FIG. 6 is a schematic diagram of latch and sensor circuitry which has three warning modes.

Instead of providing only two indications, it is possible to provide three indications, for example, "CLEAN", "EMPTY", and "SOILED", by using the circuitry schematically depicted in FIG. 6. The circuitry of FIG. 6 uses many of the same components are already described with reference to FIG. 4 and therefore those components are not described in detail here. The reset output of flip-flop 26 is applied as the set input of a flip-flop 40, whose logical outputs are "EMPTY" and "SOILED". The "SOILED" output is obtained from an AND gate 44 whose other input is the reset output of flip-flop 26. In this way the reset output of flip-flop 40 is interrupted by AND gate 44 when flip-flop 26 is set, i.e., when the dishes have just been cleaned. Flip-flop 40 receives its reset input from OR gate 37, which OR gate performs a similar function as OR gate 36. In this embodiment, OR gate 37 is controlled not only by timer 34 but also by the inverted outputs of sensors 244 (the outputs of which are inverted by invertors 42). Flip-flop 40 is set whenever flip-flop 26 is rest, that is, in response to the detection of empty racks 16 or if door 14 stays open long enough for timer 34 to time out. Flip-flop 40 is reset in response to either rack being loaded with dishes or in response to timer 34 timing out when the door 14 stays open beyond the predetermined period of time. The reset output of flip-flop 40 is effectively disabled when the dishes are subsequently washed by the action of gate 44 and the reset output of flip-flop 26 as described above.

The "CLEAN", "EMPTY" and "SOILED" outputs are preferably coupled to both the voice generator 46 and display device 52, 54 generally as shown in FIGS. 4 and 5, modified to provide three possible indications instead of two indications.

If desired, additional conditions could be displayed, such as reporting the fact that the dishes are currently being washed and/or currently being dried by making appropriate modifications to the circuitry described above.

If desired, the displayed operating condition can be manually changed by the user if appropriate inputting devices are provided, such as switches 60 and 62 shown in FIG. 6. Switch 60 places the circuitry of FIG. 6 into its "CLEAN" state while switch 62 places the circuitry into its "SOILED" state.

As previously discussed, some practicing the present invention may prefer not to use timer 34 and to locate the sensor system 24 such that it is operable even when door 14 is open. The modifications to delete timer 34 from the schematic diagrams of FIG. 3 and/or 6 are straightforward and therefore are not discussed here.

The previously described apparatus effectively weighs a rack containing the articles (i.e. dishes when the invention is used with a dishwasher) to determine when the articles have been unloaded. Instead of using a weighing apparatus, alternative apparatuses can be employed, such as a detector which determines whether a rack 16 has been fully withdrawn. In such as embodiment, the full withdrawal of a rack operates or triggers a switch which would reset flip-flop 26. The switch could be a mechanical switch, but due to the difficult environment inside an article washing machine, the switch would preferably be implemented by other means, such as a lamp and sensor arrangement, similar to those described with reference to numerals 242 and 244, but which is arranged to detect the withdrawal of the rack (i.e. its horizontal displacement) as opposed to its vertical displacement on springs 164. In view of the foregoing description, such a modification should be straightforward for those skilled in the art and therefore it is not shown in detail in the accompanying drawings.

Figure 7:
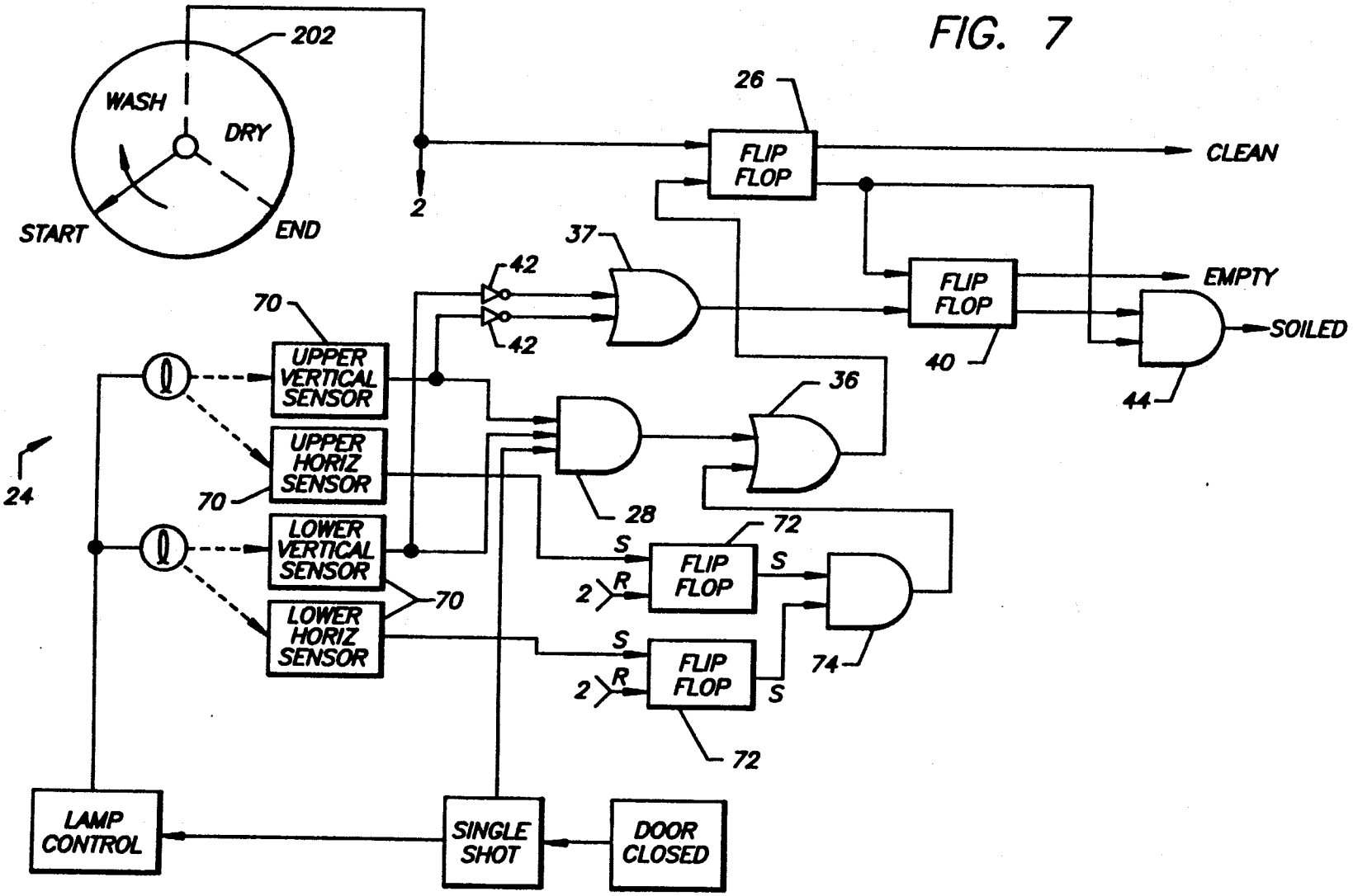
FIG. 7 is a schematic diagram generally similar to that of FIG. 6, but with rack withdrawal detector circuitry used in place of an open door timer.

It will be recalled that the weighing apparatus could possibly be "fooled" into giving an incorrect indication if the articles were unloaded and immediately replaced with soiled articles because, depending upon the location of the sensor system 24. One way of dealing with this situation was the timer 34. Instead of using a timer to determine if the washer's access door 14 is open for longer than some predetermined amount of time, the timer circuitry of FIGS. 3 and/or 6 could be replaced with rack withdrawal detector 70, such as that shown in FIG. 7, which figure is generally similar to FIG. 6. In this embodiment detectors 70 are provided by energy detectors, like detectors 244, and which are responsive to the same energy source 242, but which are arranged, as mentioned above, to detect horizontal displacement of the rack rather than vertical displacement. Of course, detectors 70 could be integrated with detectors 242 for ease of packaging.

The outputs of the horizontal displacement detectors 70 are "held" by flip-flops 72 and logically ANDed by AND gate 74, the output of which is applied to OR gate 36 as was done in FIG. 6 with the output of timer 34. The flip-flops 72 and AND gate 74 ensure that both racks are withdrawn before assuming that the clean articles have been removed and replaced with soiled articles in a single operation. Alternatively, flip-flops 72 and AND gate 74 can be effectively replaced with an OR gate so that the withdrawal of only one rack would cause that warning apparatus to assume that the clean articles have been removed and replaced with soiled articles in a single operation. This is most easily done by routing the outputs of sensors 70 logically into OR gate 36. Flip-flops 72, if used, can be reset whenever flip-flop 26 is set, i.e., when the articles have just been washed.

In the previously described embodiments the rack sensors, for both vertical and horizontal displacement, have been described with reference to a dishwasher which has, as is conventional, two racks 16. Of course, the washer may have only a single rack or more than two racks and those skilled in the art which appreciate that the changes to the previously described embodiments of the invention to account for such changes would be straightforward. Also, in order to reduce the cost of the warning system, some practicing the present invention may find it expedient to provide fewer vertical displacement sensors 24 and/or rack withdrawal (horizontal displacement) sensors 70 than the number of racks 16 in the washer.

Instead of using the discrete logic devices shown in the figures, some practicing the present invention may elect or use more highly integrated logic devices or other logic devices, and/or to reverse the logic levels and/or to use microprocessor technology to implement the present invention.

Having described the invention with respect to certain embodiments thereof, further modification will now suggest itself to those skilled in the art. The invention itself is not to be limited to the embodiments described, except as required by the appended claims.

What is claimed is:

1. In a washer for the automatic washing of articles, said washer having a timer means for controlling the automatic washing of said articles, an apparatus for reporting whether articles in the washer have been cleaned or require cleaning, said apparatus comprising:

(1) sensing means responsive to unloading of articles from said washer;

(2) state means responsive to said timer means and to said sensing means, said state means having a first state corresponding to when articles in said washer have been washed and further having a second state corresponding to when said washed articles have been unloaded from said washer, said state means being placed into its first state in response to a predetermined state of said timer means and being placed into its second state by said sensing means; and (3) reporting means responsive to the state of said state means for reporting that any articles in said washer have been cleaned when said state means is in its first state and for reporting that any articles in said washer require cleaning when said state means is in its second state.

2. The apparatus of claim 1 wherein said sensing means comprises:

(1) spring means responsive to the loading and unloading of articles in at least one rack in said washer;

(2) an energy reflector mounted on said at least one rack; and (3) an energy source and an energy detector responsive to the displacement of said reflector in response to the loading of said spring means.

3. The apparatus of claim 2 wherein said energy source is an ultraviolet source and energy detector is responsive to ultraviolet energy.

4. The apparatus of claim 1, wherein said reporting means comprises a voice generator responsive to the state of said state means and the opening of a door on said washer for reporting in an audible voice whether or not said articles in said washer are clean.

5. The apparatus of claim 1, further comprising a timer actuated in response to a door of said washer being opened, the timer generating a time-out signal when the door remains open for more than a predetermined period of time, and wherein said state means is further responsive to said time-out signal for assuming its second state.

6. The apparatus of claim 1, further comprising a rack withdrawal detector responsive to a rack of said washer being placed in a position for unloading any articles stowed therein, and wherein said state means is further responsive to said rack withdrawal detector for assuming its second state.

7. The apparatus of claim 1 wherein said sensing means is further responsive to the loading of articles into said washer, said apparatus further comprising a second state means responsive to the second state of said first mentioned state means for assuming a first state, and further responsive to said sensing means for assuming a second state in response to the loading of articles into said washer, and AND gate means responsive to the second states of both said first mentioned state means and said second state means, said AND gate means providing an output indicating that articles in said washer require washing.

8. The apparatus of claim 7 wherein said first mentioned and said second state means are provided by electronic flip-flops.

9. The apparatus of claim 1 wherein said state means is provided by an electronic flip-flop.

10. In a machine used to clean articles placed in the machine, a warning system comprising a warning device which has at least two indicating states, said device being connected to means for responding to unloading of articles from said machine, said warning device changing from one of said states to another of said states in response to said means for responding and further changing from said another or yet another of said states to said one of said states in response to at least one other condition that occurs while said machine is in operation.

11. The warning system as in claim 10, further comprising a manually-operable device for changing the state of the warning device.

12. The warning system of claim 10, wherein said warning device has two states, and wherein said warning device changes from said one of said states to a second state in response to said means for responding and further changing from said second state to said one of said states in response to said at least one other condition.

13. The warning system of claim 10, wherein said warning device has three states, and wherein said warning device changes from said one of said states to a second state in response to said means for responding and further changing from a third state to said one of said states in response to said at least one other condition.

14. An indicating system for a washer, said system having at least one rack for holding articles during the washing of same and a door for gaining access to the articles, said system comprising:

(1) detector means for sensing whether or not said at least one rack holds articles; and (2) circuit means responsive to said detector means and to the operating state of said washer for providing an indication that the articles held in said at least one rack have been cleaned when a predetermined operating state is detected and for providing an indication that newly added articles in the washer are not clean after said detector means senses that previously cleaned articles were removed from said at least one rack.

15. The system of claim 14 wherein said circuit means terminates the last mentioned indication in response to said predetermined operating state.

16. The system of claim 15 wherein said detector means is responsive to a closure of said door such that said detector means performs its sensing function shortly after each closure of said door.

17. The system of claim 16, wherein said detector means is responsive to an opening of said door such that said detector means performs its sensing function after each opening of said door.

18. The system of claim 17 wherein said detector means comprises:

(1) spring means responsive to the loading and unloading of articles in at least one rack in said washer;

(2) an energy reflector mounted on said at least one rack; and (3) an energy source and an energy detector responsive to the displacement of said reflector in response to the loading of said spring means.

19. The apparatus of claim 18 wherein said energy source is an ultraviolet source and energy detector is responsive to ultraviolet energy.

20. The apparatus of claim 19, wherein said circuit means comprises a voice generator responsive to the state of said detector means and the opening of a door on said washer for reporting in an audible voice whether or not articles in said washer are clean.

21. The system of claim 14 wherein said detector means is responsive to a closure of said door such that said detector means performs its sensing function shortly after each closure of said door.

22. The system of claim 14 wherein said detector means comprises:

(1) spring means responsive to the loading and unloading of articles in at least one rack in said washer; and (2) a sensor responsive to the displacement of said spring means.

23. In a washer for the automatic washing of articles, said washer having a timer means for controlling the automatic washing of said articles, an apparatus for reporting whether any articles in the washer have been cleaned or require cleaning, said apparatus comprising:

(1) a sensing device responsive to unloading of articles from said washer and comprising:

(a) spring means responsive to the loading and unloading of articles in at least one rack in said washer;

(b) an energy reflector mounted on said at least one rack; and (c) an energy source and an energy detector responsive to the displacement of said reflector in response to the loading of said spring means;

(2) state means responsive to the state of said timer means and to said sensing device, said state means having a first state corresponding to when any articles in said washer have been washed and further having a second state corresponding to when said washed articles have been unloaded from said washer; and (3) reporting means responsive to the state of said state means for reporting that any articles in said washer have been cleaned when said state means is in its first state and for reporting that any articles in said washer require cleaning when said state means is in its second state.

24. The apparatus of claim 23 wherein said energy source is an ultraviolet source and said energy detector is responsive to ultraviolet energy.

25. In a washer for the automatic washing of articles, said washer having a first timer means for controlling the automatic washing of said articles, an apparatus for reporting whether said articles in the washer have been cleaned or require cleaning, said apparatus comprising:

(1) second timer means actuated in response to a door of said washer being opened for generating a time-out signal when the door remains open for more than a predetermined period of time;

(2) state means responsive to the state of said first and second timer means and having a first state corresponding to when said articles in said washer have been washed and further having a second state corresponding to when said washed articles have been unloaded from said washer, said state means being responsive to said time-out signal for assuming its second state; and (3) reporting means responsive to the state of said state means for reporting that said articles in said washer have been cleaned when said state means is in its first state and for reporting that articles in said washer require cleaning when said state means is in its second state.

26. The apparatus of claim 25, further comprising a sensing device responsive to unloading of said articles from said washer and wherein said state means is further responsive to the sensing device for assuming its second state in response to the unloading of said articles.

27. In a washer for the automatic washing of articles, said washer having at least one rack and having a timer means for controlling the automatic washing of said articles; an apparatus for reporting whether any articles in the washer have been cleaned or require cleaning, said apparatus comprising:

(1) a rack withdrawal detector responsive to a rack of said washer being placed in a position for unloading the articles stowed therein;

(2) state means responsive to the state of said timer means and to said rack withdrawal detector, said state means having a first state corresponding to when any articles in said washer have been washed by said washer and further having a second state corresponding to when said washed articles have been unloaded from said washer, said state means being responsive to said rack withdrawal detector for assuming its second state; and (3) reporting means responsive to the state of said state means for reporting that any articles in said washer have been cleaned when said state means is in its first state and for reporting that any articles in said washer require cleaning when said state means is in its second state.

28. The apparatus of claim 27, wherein said washer has two racks for temporarily receiving the articles to be washed, said apparatus having two rack-withdrawal detectors, and sensing devices responsive to unloading of said articles from said racks, wherein said state means assumes its second state after the washer has washed the articles therein and (1) when both of said rack withdrawal detectors sense that their associated racks have been withdrawn or (2) when said sensing devices sense that both racks are empty.

29. In a washer for the automatic washing of articles, said washer having a timer means for controlling the automatic washing of said articles, an apparatus for reporting whether said articles in the washer have been cleaned or require cleaning, said apparatus comprising:

(1) a sensing device responsive to the loading and unloading of said articles from said washer;

(2) first state means responsive to the state of said timer means and having a first state corresponding to when said articles in said washer have been washed and further having a second state corresponding to when said washed articles have been unloaded from said washer;

(3) second state means responsive to the second state of said first state means for assuming a first state, and further responsive to said sensing device for assuming a second state in response to the loading of articles into said washer and AND gate means responsive to the second states of both said first state means and said second state means, said AND gate means providing an output indicating that said articles in said washer require washing; and (4) reporting means responsive to the state of said first and second state means for reporting that said articles in said washer have been cleaned when said first state means is in its first state, for reporting that articles in said washer require cleaning when said first and second state means are in their second states, and for reporting that the washer is empty when said first state means is in its second state and said second state means is in its first state.

30. In a washer for the automatic washing of articles, said washer having a timer means for controlling the automatic washing of said articles, an apparatus for reporting whether said articles in the washer have been cleaned or require cleaning, said apparatus comprising:

(1) a sensing device responsive to the loading and unloading of said articles from said washer;

(2) state means responsive to the state of said timer means and having a first state corresponding to when said articles in said washer have been washed, having a second state corresponding to when said washed articles have been unloaded from said washer, and having a third state corresponding to when said washer is empty of articles; and (3) reporting means responsive to the state of said state means for reporting that said articles in said washer have been cleaned when said state means is in its first state, for reporting that articles in said washer require cleaning when said state means is in its second state, and for reporting that the washer is empty when said state means is in its third state.

31. In a machine used to clean articles placed in the machine, a warning device having at least two states, means for responding to removal of the articles from the machine, said warning device changing from a first one of said states to another one of said states in response to said means for responding and further changing from said another or yet another one of said states to said first one of said states in response to said machine being in operation and having at least started a cleaning cycle.

32. The warning device of claim 31, wherein said warning device has two states, said warning device changing from said one of said states to a second state in response to said means for responding and further changing from said second state to said one of said states in response to said machine being in operation and having at least started a cleaning cycle.

33. The warning device of claim 31, wherein said warning device has three states, and wherein said warning device changes from said one of said states to a second state in response to said means for responding and further changing from a third state to said one of said states in response to said machine being in operation and having at least started a cleaning cycle.

34. A warning apparatus for use with a cleaning apparatus having a cavity and a device for controlling said cleaning apparatus, said warning apparatus comprising:

means responsive to unloading of articles from said cavity; and a reporting device responsive to said means responsive to unloading of articles and to said device for controlling said cleaning apparatus, said reporting device providing different reports respectively when said means responsive to unloading of articles indicates the unloading of said articles from said cavity and when said device for controlling said cleaning apparatus enters a predetermined state.

35. The warning system of claim 34, wherein said device for controlling is a timing device and said reporting device provides a predetermined report in response to a predetermined state of said timing device.

36. A warning apparatus for use with a cleaning apparatus for cleaning articles placed in a cleaning compartment and a timer for controlling said cleaning apparatus, said warning apparatus comprising:

(a) a sensor responsive to unloading of articles from said compartment; and (b) a reporting device responsive to said sensor and to said timer for providing different reports respectively when said sensor senses the unloading of articles from said compartment and when said timer enters a predetermined state.

37. A warning device as claimed in claim 36, wherein said cleaning apparatus is a dishwasher and wherein said articles are dishes.

* * * * *